US012584500B2

(12) United States Patent
Kumar et al.

(10) Patent No.: US 12,584,500 B2
(45) Date of Patent: Mar. 24, 2026

(54) SYSTEMS AND METHODS FOR INTEGRALLY GEARED CENTRIFUGAL COMPRESSOR TO MAINTAIN ROTOR CONCENTRICITY WITH DIFFERING PINION GEAR TOOTH COUNTS

(71) Applicant: Ingersoll-Rand Industrial U.S., Inc., Davidson, NC (US)

(72) Inventors: Dhruv Kumar, Buffalo, NY (US); Thomas Gerber, Buffalo, NY (US); Andrew Austin, Orchard Park, NY (US); Chester Swiatek, Buffalo, NY (US); Scott Ackerman, Lancaster, NY (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 0 days.

(21) Appl. No.: 19/075,156

(22) Filed: Mar. 10, 2025

(65) Prior Publication Data

US 2025/0207612 A1 Jun. 26, 2025

Related U.S. Application Data

(63) Continuation of application No. 18/476,013, filed on Sep. 27, 2023, now Pat. No. 12,247,583, which is a (Continued)

(51) Int. Cl.

| | |
|---|---|
| ***F04D 29/42*** | (2006.01) |
| ***F04D 29/66*** | (2006.01) |
| *F04D 27/02* | (2006.01) |

(52) U.S. Cl.

CPC ..... *F04D 29/667* (2013.01); *F04D 29/4206* (2013.01); *F04D 27/02* (2013.01)

(58) Field of Classification Search

CPC ..... F04D 29/667; F04D 29/4206

See application file for complete search history.

(56) References Cited

U.S. PATENT DOCUMENTS

| | | | |
|---|---|---|---|
| 1,799,100 | A | 3/1931 | Keil |
| 3,150,533 | A | 9/1964 | Ferdinand |

(Continued)

FOREIGN PATENT DOCUMENTS

| | | | |
|---|---|---|---|
| CN | 110894838 | A | 3/2020 |
| CN | 210484418 | U | 5/2020 |

OTHER PUBLICATIONS

Notification of the First Office Action in China for Application No. 2022116525038, dated Apr. 13, 2025.

(Continued)

*Primary Examiner* — Sabbir Hasan

(74) *Attorney, Agent, or Firm* — Kevin E. West; Advent, LLP

(57) ABSTRACT

Integrally geared centrifugal compressor systems are described that include eccentric cartridges that house bearings and seals to maintain rotor concentricity for a variety of pinons integrated in a fixed gearbox design to provide multiple impeller speeds with a single gearbox design. In an aspect, a system includes, but is not limited to, a pinion configured to be rotated by a bull gear about a rotational axis; a rotor coupled to the pinion; and an eccentric cartridge configured to house a bearing assembly through which the rotor extends to support rotation of the rotor, the eccentric cartridge having an outer surface and an inner surface, wherein the inner surface is eccentric relative to the outer surface to align the rotational axis with a center axis of the bearing assembly.

6 Claims, 6 Drawing Sheets

Related U.S. Application Data continuation of application No. 17/564,987, filed on Dec. 29, 2021, now Pat. No. 11,795,976.

(56) References Cited

U.S. PATENT DOCUMENTS

| | | | | |
|---|---|---|---|---|
| 7,189,052 | B2 | 3/2007 | Jones | |
| 8,616,836 | B2 | 12/2013 | Blair et al. | |
| 9,033,651 | B2 * | 5/2015 | Czechowski | F04D 29/104 415/112 |
| 9,371,838 | B2 | 6/2016 | Small et al. | |
| 10,132,319 | B2 * | 11/2018 | Kolstrup | F04D 17/08 |
| 2006/0093477 | A1 | 5/2006 | Jones | |
| 2010/0098534 | A1 | 4/2010 | Small et al. | |
| 2018/0283389 | A1 | 10/2018 | Fujioka | |

OTHER PUBLICATIONS

Extended European Search Report for Application No. 22190283.6, dated May 23, 2023.
Communication pursuant to Article 94(3) EPC for Patent Application No. 22190283.6, dated Oct. 7, 2025.
Notification of Second Office Action in China for Patent Application No. 2022116525038, dated Sep. 13, 2025.
Office Action in China for Application No. 202211652503.8, dated Nov. 28, 2025.

* cited by examiner

SYSTEMS AND METHODS FOR INTEGRALLY GEARED CENTRIFUGAL COMPRESSOR TO MAINTAIN ROTOR CONCENTRICITY WITH DIFFERING PINION GEAR TOOTH COUNTS

BACKGROUND

Compressors are fluid systems that compress a fluid, such as a gas or vapor, to pressurize the fluid and supply the pressurized fluid for use as a working fluid. Compressors can utilize a variety of mechanisms to compress the fluid and can include reciprocating compressors, rotary compressors, and centrifugal compressors. Reciprocating compressors can include pistons that compress a volume of fluid within a compression cylinder. Rotary compressors include various structures, such as screws, scrolls, and gears, that rotate and create varying volumes into which fluid is introduced and compressed as the volume between the structures decreases. Centrifugal compressors utilize a rotating impeller to compress fluids and direct the compressed fluids to radially-positioned outlets. Centrifugal compressors are generally used when a high volume of compressed fluid, such as air, is desired (e.g., for industrial or commercial uses).

SUMMARY

Integrally geared centrifugal compressor systems are described that include eccentric cartridges that house bearings and seals to maintain rotor concentricity for a variety of pinons integrated in a fixed gearbox design to provide multiple impeller speeds with a single gearbox design. In an aspect, a system includes, but is not limited to, a pinion configured to be rotated by a bull gear about a rotational axis; a rotor coupled to the pinion and configured to be rotated about the rotational axis; and an eccentric cartridge configured to house a bearing assembly through which the rotor extends to support rotation of the rotor about the rotational axis, the eccentric cartridge having an outer surface and an inner surface, at least a portion of the outer surface configured to seat against an interior surface of a gearbox configured to house at least a portion of the pinion and the rotor, at least a portion of the inner surface configured to support the bearing assembly, wherein the inner surface is eccentric relative to the outer surface to align the rotational axis with a center axis of the bearing assembly.

In an aspect, a system includes, but is not limited to, a first pinion configured to be rotated by a bull gear about a first rotational axis; a first eccentric cartridge configured to house a first bearing assembly through which a first rotor coupled to the first pinion extends to support rotation of the first rotor about the first rotational axis, the first eccentric cartridge having a first outer surface and a first inner surface, wherein the first inner surface is eccentric relative to the first outer surface to align the first rotational axis with a center axis of the first bearing assembly; a second pinion configured to be rotated by the bull gear about a second rotational axis; a second eccentric cartridge configured to house a second bearing assembly through which a second rotor coupled to the second pinion extends to support rotation of the second rotor about the second rotational axis, the second eccentric cartridge having a second outer surface and a second inner surface, wherein the second inner surface is eccentric relative to the second outer surface to align the second rotational axis with a center axis of the second bearing assembly; and a gearbox defining an interior longitudinal cavity configured to interchangeably receive each of (i) the first pinion and the first eccentric cartridge and (ii) the second pinion and the second eccentric cartridge, wherein the first rotational axis is eccentrically arranged relative to the second rotational axis.

In an aspect, a system includes, but is not limited to, a pinion configured to be rotated by a bull gear about a rotational axis; a rotor coupled to the pinion and configured to be rotated about the rotational axis; an eccentric cartridge configured to house a bearing assembly through which the rotor extends to support rotation of the rotor, the eccentric cartridge having an outer surface and an inner surface, at least a portion of the outer surface configured to seat against an interior surface of a gearbox, at least a portion of the inner surface configured to support the bearing assembly, wherein the inner surface is eccentric relative to the outer surface to align the rotational axis with a center axis of the bearing assembly; and a gearbox defining an interior longitudinal cavity configured to receive the eccentric cartridge, the interior longitudinal cavity of the gearbox having a center axis that is eccentrically arranged relative to the rotational axis and to the center axis of the bearing assembly.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Overview

Figure 1:
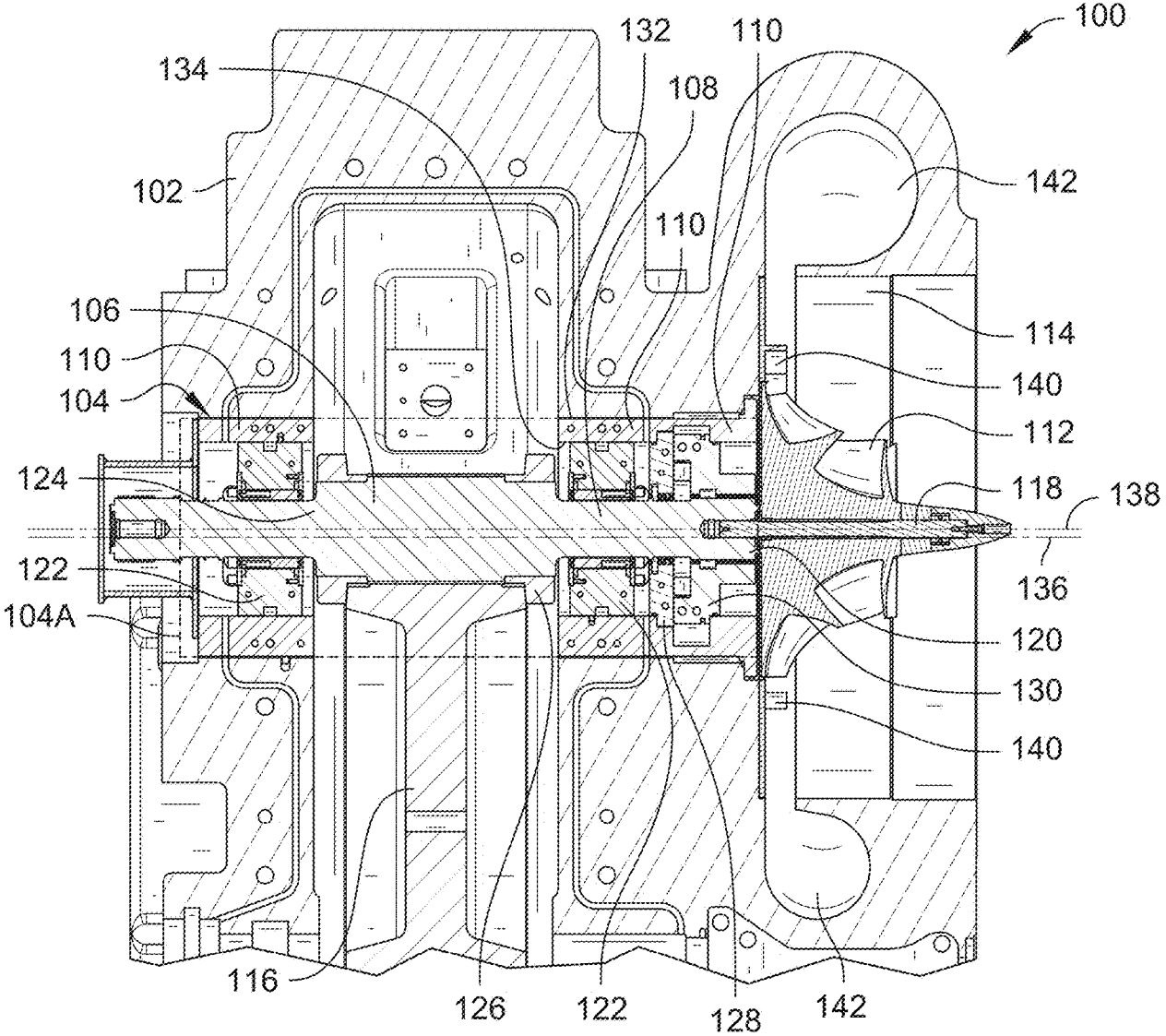
FIG. 1 is a partial cross-sectional view of an integrally geared centrifugal compressor system including a gearbox including an eccentric cartridge having an eccentricity between an outer surface and an inner surface used to support bearings to mount a rotor concentrically with the bearings in accordance with an example embodiment of the present disclosure.

Compressed fluid systems treat a source of fluid, such as environmental air, by compressing the fluid to provide a source of compressed fluid (e.g., compressed air) for work applications. For integrally geared centrifugal compressors, a bull gear is driven by a motor to rotate a pinion housed within a gearbox. The pinion is coupled to a rotor which turns an impeller used to interact with the fluid being compressed to accelerate the fluid which is discharged from the impeller at a high-velocity. The high-velocity fluid enters a diffuser that includes aerodynamic features that act on the high-velocity flow to reduce the velocity and increase the pressure of the fluid. A volute is coupled to the gearbox and positioned around the diffuser to collect fluid from a radial outlet that extends 360 degrees around the diffuser. The volute generally includes an annular collection chamber that discharges flow through a discharge passage.

In current systems, the gearbox is designed to support a particular gear tooth count for the pinion to maintain concentricity between the pinion and the gearbox, which in turn provides concentricity between the pinion and bearings/seals used to support the rotor within the gearbox. With the impeller being coupled to the rotor, the impeller is concentric with the pinion and is also concentric with the volute. A compressor package that includes piping, valves, and other compressor components to direct the flow of fluid and compressed fluid through the compressor system is also designed to support the gearbox designed to match the particular gear tooth count for the pinion. The size of the pinion can dictate the gear tooth count supported by the pinion, which in turn translates to a rotational speed supported by the pinion. In general, a pinion diameter increases as the gear tooth count of the pinion increases. For a given rotational speed of the bull gear used to drive the pinion, a pinion having a lower gear tooth count will rotate more quickly than a pinion having a higher gear tooth count, which translates to differing impeller speeds for differing pinion gear tooth counts.

However, if a different operational speed for the impeller is desired, the gearbox and package designs would change to accommodate the different pinion diameter. For instance, for a gearbox design, the mating interface between the teeth of the bull gear and the pinion is maintained at a given position within the gearbox, however if the pinion gear tooth count increased, the diameter of the pinion changes, thus extending the center of rotation of the pinion further away from the bull gear. As the center of rotation is extended away from the bull gear, the pinion would no longer align with the bearings and seals used to maintain rotation of the rotor within the gearbox, thus resulting in redesign of the gearbox and associate compressor package supporting the gearbox. Such redesign of the gearbox and package can result in increased cost for the compressor system, such as through engineering time for the new designs, downtime of industrial systems to facilitate introduction of a new compressor or modification to existing compressor systems, and the like.

Accordingly, the present disclosure is directed, at least in part, to systems and methods to maintain rotor concentricity with rotor bearings for a variety of pinon gear tooth counts for a fixed gearbox design of a centrifugal compressor to provide multiple impeller speeds with a single gearbox design. The single gearbox design can therefore support multiple pinions having differing dimensions due to differing gear tooth counts individually within the gearbox without altering the gearbox dimensions or the supporting package design when changing between pinions for differing compression characteristics (e.g., slower air speeds, faster air speeds, etc.). In an aspect, the centrifugal compressor includes an eccentric cartridge that supports rotor bearings and seals within the gearbox to maintain concentricity of the pinion, rotor, bearings/seals, and impeller. The eccentric cartridge includes an outer surface that interfaces with an interior surface of the gearbox forming the chamber in which the rotor is positioned. The cartridge also includes an inner surface configured to support one or more bearings, seals, or combinations thereof to facilitate rotation of the rotor through an aperture defined by the cartridge. The inner surface of the cartridge is eccentric relative to the outer surface of the cartridge to permit the cartridge to fit within the gearbox while positioning the bearings, seals, and rotor concentrically with the pinion and eccentrically with the gearbox. In an aspect, the impeller is positioned concentrically with the pinion and eccentrically with the volute. Differing pinion sizes can be supported within a single gearbox design by varying the amount of eccentricity between the inner surface of the cartridge and the outer surface of the cartridge to provide capability for multiple impeller speeds with a single gearbox design.

Example Implementations

Referring to FIG. 1, an integrally geared centrifugal compressor system ("system 100") for maintaining rotor concentricity for a variety of pinon sizes and gear tooth configurations integrated in a fixed gearbox design to provide multiple impeller speeds is shown in accordance with example embodiments of the present disclosure. The system 100 is shown generally including a compressor package housing 102, a gearbox 104 within the housing 102, a pinion 106 and a rotor 108 supported within the gearbox 104, a plurality of eccentric cartridges 110, an impeller 112, and a volute 114. The pinion 106 is driven via complementary geared connection with a bull gear 116 driven by a motor (not shown) such that rotation of the bull gear 116 results in rotation of the pinion 106. The pinion 106 includes or is coupled with the rotor 108, which in turn is coupled with the impeller 112. For example, the system 100 can include a rod 118 coupled to an end 120 of the rotor 108 (e.g., via threaded engagement or other connection) with the impeller 112 coupled to the rotor 108 via the rod 118. As the pinion 106 is rotated through action of the bull gear 116, the rotor 108 and the impeller 112 are rotated to act upon fluid received by the system 100. While a single impeller 112 is shown, the system is not limited to a single impeller configuration and can include multiple impellers 112, such as another impeller 112 coupled to the pinion 106 via the rotor 108 opposite the impeller 112 shown.

The system 100 includes the eccentric cartridges 110 to support bearings and seals within the gearbox 104 to support the rotor 108 for rotation while concentrically aligning the pinion 106 with the bearings and the impeller 112. For example, the system 100 is shown including an eccentric cartridge 110 housing a bearing assembly ("bearing 122") at one end 124 of the pinion 106 and a second eccentric cartridge 110 adjacent a second end 126 of the pinion 106 housing another bearing 122 to support rotation of the rotor 108 within the gearbox 104. The system 100 can also include an eccentric cartridge 110 to house one or more seals. For example, the system 100 is shown with an eccentric cartridge 110 between the pinion 106 and the impeller 112 supporting an oil seal 128 and an air seal 130 in addition to the bearing 122.

The eccentric cartridges 110 include an outer surface 132 configured to seat against an interior surface of the gearbox 104 and an inner surface 134 to support the bearings 122 and/or the seals. In implementations, the inner surface 134 forms a generally circular aperture to house a generally circular bearing structure and the outer surface 132 has a generally circular cross-sectional shape to sit within a generally circular cross-sectional cavity formed by the gearbox 104. For example, the cartridge 110 can have a generally cylindrical shape to seat within a generally cylindrical portion of the gearbox 104, as shown in FIGS. 1 and 2. However, the system 100 is not limited to such configurations and can include differing shapes for the inner surface 134 (e.g., to support different bearing structures), the outer surface 132 (e.g., to fit within differing cavity shapes within the gearbox 104), or combinations thereof. The inner surface 134 is eccentric relative to the outer surface 132 such that when the eccentric cartridges 110 are secured within the gearbox 104, the pinion 106, the rotor 108, the bearings 122, the oil seal 128, and the air seal 130 are concentrically arranged relative to each other and are eccentrically arranged relative to the gearbox 104. For instance, the gearbox 104 includes an interior longitudinal cavity 104A to house the pinion 106, the rotor 108 (where a portion of the rotor 108 may extend beyond the gearbox 104 to interface with the impeller 112 or with a mounting pin on the opposite end of the rotor 108), and the cartridges 110. A center axis of the longitudinal cavity 104A of the gearbox 104 is shown in FIG. 1 as reference character 136 and a center axis of the pinion 106 (e.g., about which the pinion 106 rotates) and of the bearings 122 (e.g., through which the rotor 108 extends) is shown as reference character 138, displaced from the center axis of the gearbox 104. The center axes 136 and 138 are in a substantially parallel configuration. The eccentric cartridges 110 are shown having a larger material width between the inner surface 134 and the outer surface 132 on the side of the gearbox 104 adjacent the bull gear 116 as compared to the material width between the inner surface 134 and the outer surface 132 on the side of the gearbox 104 opposite the bull gear 116, which accounts for the displacement between the center axes 136 and 138.

Figure 2B:
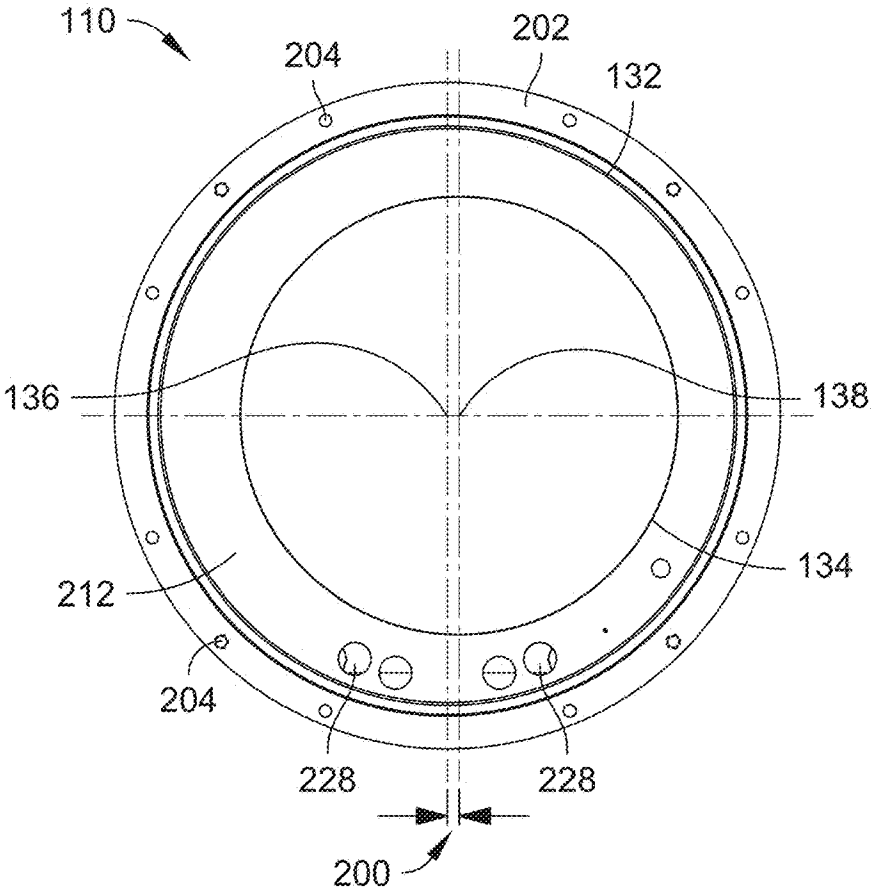
FIG. 2B is an end view of the cartridge of FIG. 1, showing the eccentricity of the inner surface relative to the outer surface.
Figure 2A:
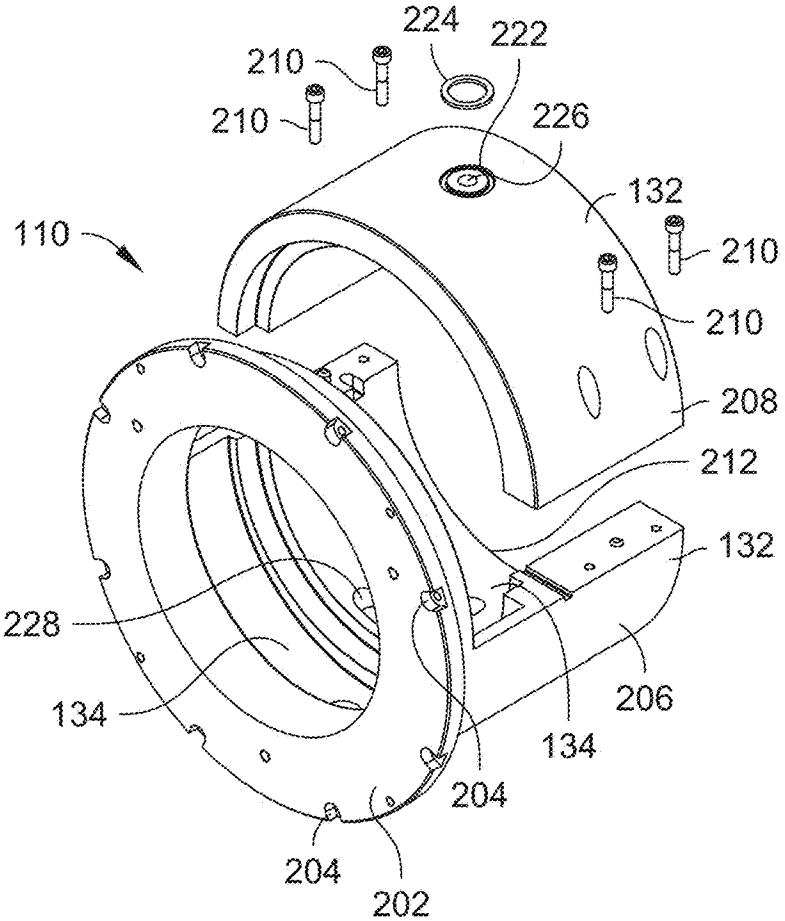
FIG. 2A is an exploded isometric view of the cartridge of FIG. 1.
Figure 2C:
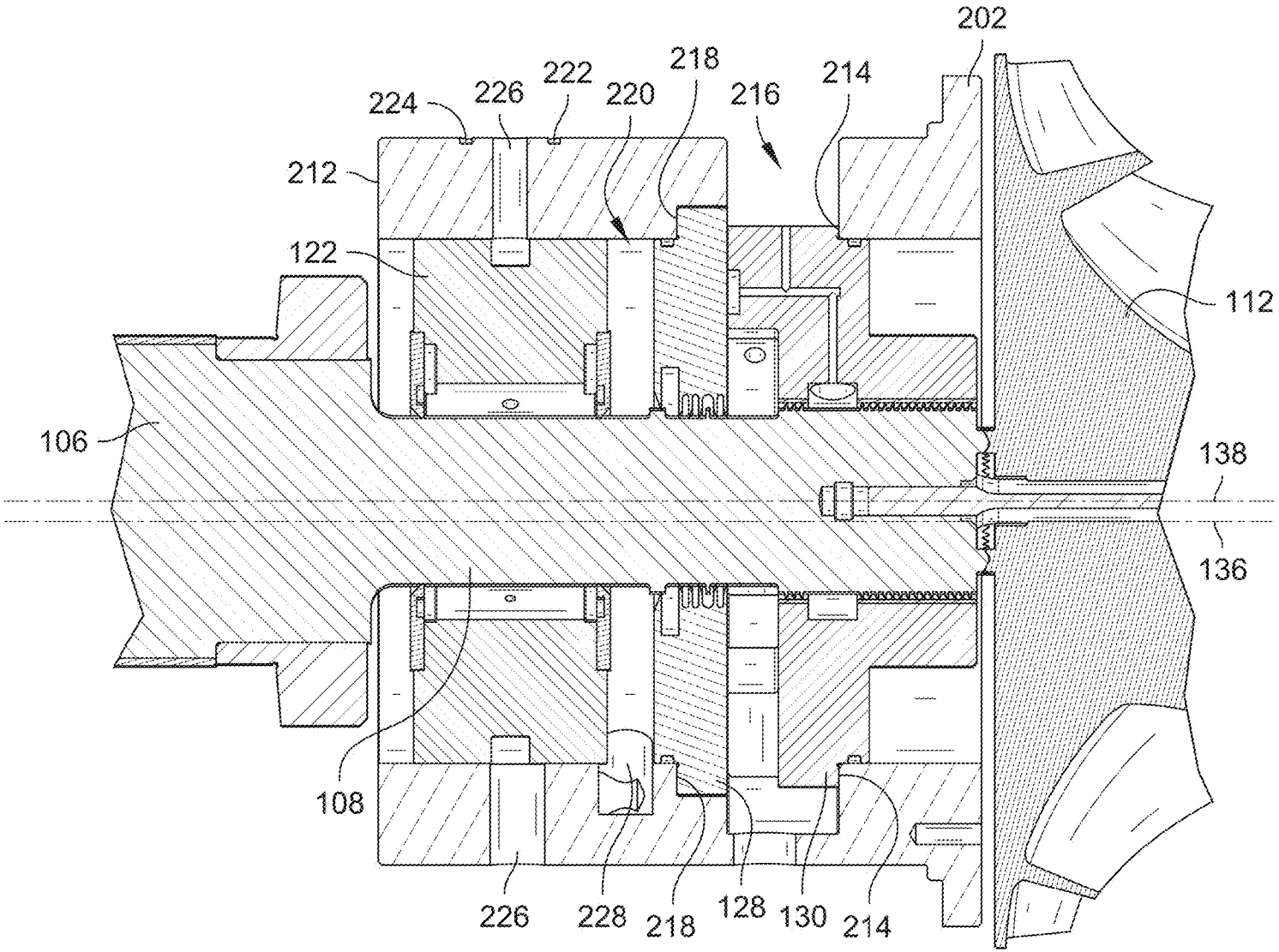
FIG. 2C is a partial cross-sectional view of the cartridge of FIG. 2A with a bearing, oil seal, and air seal installed in accordance with an example embodiment of the present disclosure.

An example eccentric cartridge 110 is shown in FIGS. 2A-2C. An offset 200 is shown between the center axis of the outer surface 132 (e.g., which corresponds to the center axis 136 when installed in the gearbox 104) and the center axis of the inner surface 134 (e.g., which corresponds to the center axis 138 when installed in the gearbox 104) to provide the eccentricity between the inner surface 134 and the outer surface 132. Different pinion structures can be accommodated by the eccentric cartridge 110 by varying the offset 200. For example, as the offset 200 is increased, larger pinions 106 can be introduced into the gearbox 104 to incorporate larger gear tooth counts, resulting in a reduction in speed of rotation of the rotor 108. As the offset 200 is decreased, smaller pinions 106 can be introduced into the gearbox 104 to incorporate smaller gear tooth counts, resulting in an increase in speed of rotation of the rotor 108. In an example implementation, the offset 200 can range from about 0.1 inches to about 1.5 inches, however, the system 100 is not limited to such ranges and can be less than about 0.1 inches or more than about 1.5 inches.

For a given gearbox 104 design, a plurality of eccentric cartridges 110 having different dimensions of offsets 200 can be interchangeably received in the gearbox 104 (e.g., in the longitudinal cavity 104A) to provide support of different sizes of pinions 106 without changing the internal dimensions of the gearbox 104 or housing 102. For such interchangeability, the outer surface 132 of each eccentric cartridge 110 maintains substantially the same dimensions and the offset 200 is different to shift the eccentricity of the inner surface 134 to account for the differing pinion 106 sizes. For example, to support interchangeability of the eccentric cartridges 110 into the gearbox 104, such as into the longitudinal cavity 104A, the portion of the gearbox 104 that interfaces with the eccentric cartridges 110 is unchanged, where the differences in the offset 200 in the eccentric cartridges provides for the ability of the system 100 to provide multiple operating conditions without adjusting the design of the gearbox 104. For instance, a first pinion having a first gear tooth count can be installed into the gearbox 104 and a first eccentric cartridge 110 having a first offset 200 is also secured into the gearbox 104 for a first operational parameter of the system 100 and a second pinion 106 having a second gear tooth count can be installed into the gearbox and a second eccentric cartridge 110 having a second offset 200 that differs from the first offset 200 can be interchangeably secured into the gearbox 104 for a second operational parameter of the system 100, such as a faster compressed air velocity (e.g., when the second pinion has a smaller gear tooth count than the first pinion). As such, the system 100 can be utilized to provide a range of speeds of the impeller 112 via changing the pinions 106 and the offset 200 of the eccentric cartridges 110 without requiring a redesign of the gearbox 104 or package components. Moreover, for systems where multiple impellers 112 are utilized on a single axis of rotation (e.g., on opposing ends of a rotor rotated by a single pinion), a single eccentric cartridge 110 can be utilized for a first configuration where a larger tooth count rotor is positioned in the gearbox 104 to provide a first offset 200 and the same eccentric cartridge 110 can be utilized for a second configuration with the eccentric cartridge 110 flipped for insertion in the opposite end of the system 100 (e.g., within a second volute 114 on the opposite end of the first volute 114) to support a smaller tooth count rotor about an axis of rotation with a second offset from the center axis 136, where the first offset and the second offset provide the same offset but in opposite directions from the center axis 136. For example, if the center axis 136 would support rotation of a pinion 106 having a tooth count of thirty, the same eccentric cartridge 110 could be utilized for a pinion 106 having a tooth count of thirty four on one end of the longitudinal cavity 104A and inserted into the opposite end of the longitudinal cavity 104A to support rotation of a rotor 108 connected to a pinion 106 having a tooth count of twenty six.

The eccentric cartridge 110 can include features to assist in installation within the gearbox 104 and alignment of the components supported by the eccentric cartridge 110 (e.g., the oil seal 128, the air seal 130, and/or the bearing 122). For example, the eccentric cartridge 110 can include a flange 202 disposed on one end of the eccentric cartridge 110. The flange 202 defines a plurality of apertures 204 (e.g., disposed about a perimeter of the flange 202) to receive fasteners to couple the flange 202 to the gearbox 104 at an end of the longitudinal cavity 104A adjacent the impeller 112. In implementations, the eccentric cartridge 110 includes a body portion 206 and a cover portion 208 configured to be secured to the body portion 206 (e.g., via one or more fasteners, such as bolts 210). The body portion 206 is shown in FIG. 2A as including the flange 202 and extends outward from the flange 202 to an end 212 of the body portion 206 to define a base upon which the oil seal 128, the air seal 130, and the bearing 122 are seated when installed in the eccentric cartridge 110.

In implementations, the eccentric cartridge 110 provides control of the axial positioning of the air seal 130 and the oil seal 128 relative to the gearbox 104 and the impeller 112 to ensure that the air seal 130 and the oil seal 128 are properly positioned in the body portion 206 to provide proper sealing functionality within the gearbox 104. An example installation process includes inserting the end 212 of the body portion 206 into the gearbox 104 through the volute 114 and securing fasteners through the apertures 204 in the flange 202 and into the gearbox 104. A seal, such as an o-ring, can be positioned between the flange 202 and the gearbox 104 to provide an air-tight seal of the eccentric cartridge 110 within the gearbox 104. The flange 202 and the apertures 204 provide alignment of the eccentric cartridge 110 relative to the gearbox 104 and also prevent substantial rotation of the eccentric cartridge 110 within the gearbox 104. For instance, if the eccentric cartridge 110 was able to rotate within the gearbox 104, the center axis 138 would change due to the eccentricity of the cartridge, which would impact performance of the system 100 through changed alignment of the bull gear 116 relative to the pinion 106 (e.g., and the gear meshing therebetween). As such, the fasteners through the flange 202 can prevent substantial rotation of the eccentric cartridge 100 to stabilize the positioning of the center axis 138.

With the cover portion 208 removed from the body portion 206, the air seal 130 can be inserted into the end 212 and slid axially along the center axis 138 until a portion of the air seal 130 abuts a first edge 214 of the body portion 206. In implementations, the eccentric cartridge 110 includes a gap 216 positioned between the cover portion 208 and the body portion 206 through which the air seal 130 can be viewed to ensure proper alignment of the air seal 130 within the body portion 206, even while the cover portion 208 is secured to the body portion 206. With the air seal 130 in place and with the cover portion 208 removed, the oil seal 128 can be placed within the body portion 206 to abut the air seal 130 and a second edge 218 of the body portion 206. Upon startup of the system 100, air pressure can push the air seal 130 against the oil seal 128, where the edge 218 prevent further motion of the seals to axially locate the oil seal 128 within the eccentric cartridge 110 and ensure proper alignment of rotor teeth and channels within the seals to permit the flow of oil or air against the rotor 108. The bearing 122 is also seated within the body portion 208 with the cover portion 208 removed and can be aligned via a pin and slot arrangement or other alignment structure. In implementations, the eccentric cartridge 110 includes a gap 220 between the bearing 122 and the oil seal 128. With the seals and bearing in place, the cover portion 208 can be secured to the body portion 206 to clamp the components within the eccentric cartridge 110 for proper positioning within the gearbox 104.

In implementations, the eccentric cartridge 110 includes seals positioned on an exterior surface of the eccentric cartridge 110 to facilitate introduction of pressurized oil to the bearing 122 without permitting oil to leak from the gearbox to the atmosphere (e.g., via air ports used for the air seal 130). For example, the eccentric cartridge 110 is shown with a circular groove 222 on an exterior surface of the cover portion 208 that supports a seal 224 which surrounds an oil channel 226 formed through the cover portion 208 to supply pressurized oil to the bearing 122. The oil seal 128 prevents passage of oil to the air seal 130 through the interior of the eccentric cartridge 110 and the seal 224 prevents passage of oil across the exterior of the eccentric cartridge. In implementations, the body portion 206 can include a similar groove/seal arrangement for supply of pressurized oil from another location into the eccentric cartridge 110. Oil supplied into the eccentric cartridge 110 can then drain from the eccentric cartridge 110 into the gearbox 104 through one or more drain channels 228 that are fluidically coupled between the inner surface 134 and the end 212 of the body portion 206.

Figure 4A:
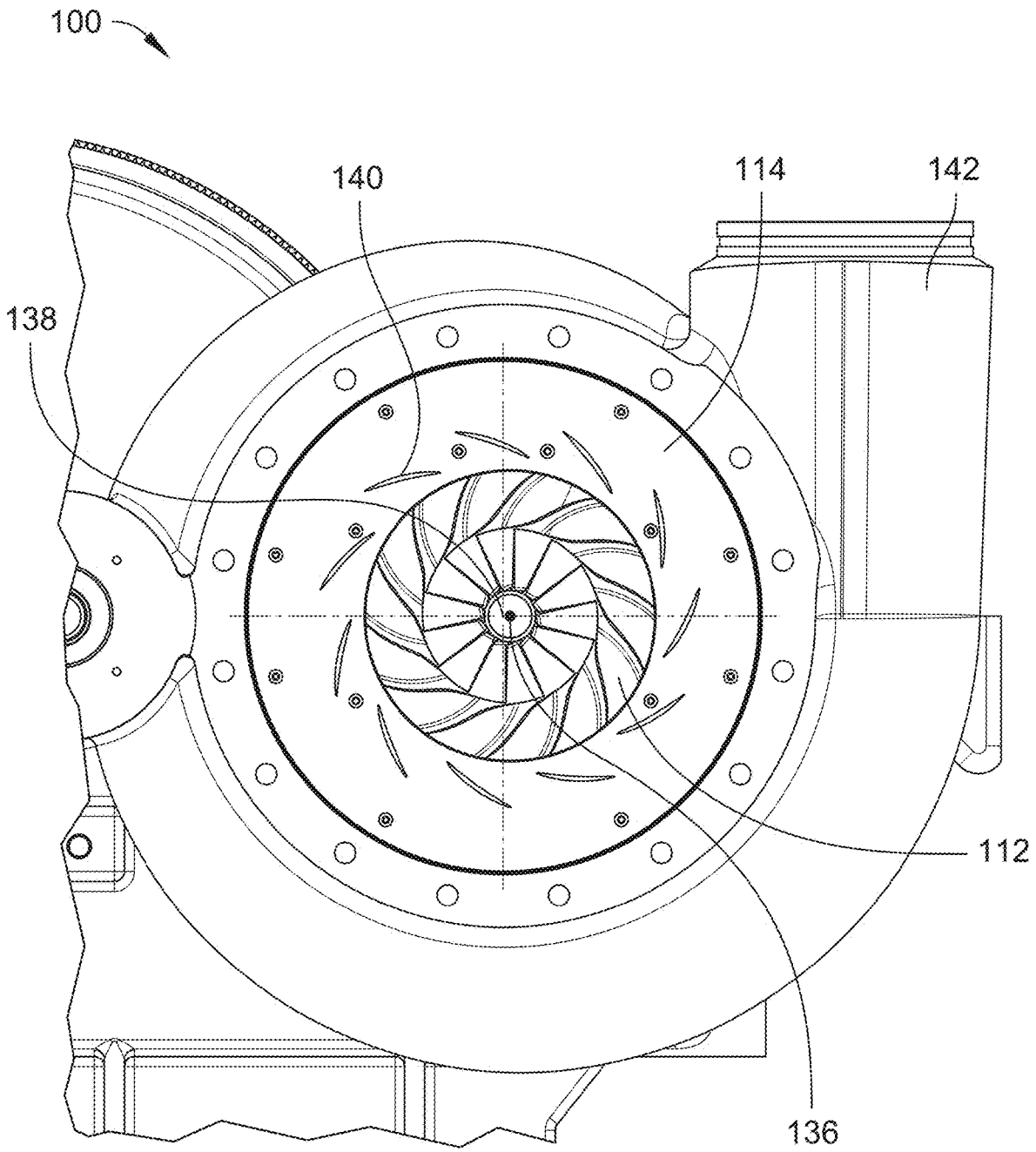
FIG. 4A is a partial end view of the system of FIG. 1, showing eccentricity of the impeller relative to the volute configured to receive compressed fluid from the impeller in accordance with an example embodiment of the present disclosure.

Referring again to FIG. 1, the system 100 is shown including the impeller 112 positioned relative to the volute 114 to direct fluid ejected by the impeller 112, through a diffusion space (vaned or vaneless), into the volute 114. The impeller 112 extends beyond the bearing 122 that supports the rotor 108 and, as such is supported in a cantilever fashion, however, the system 100 is not limited to such configurations and other support schemes can be used to support the impeller 112. The impeller 112 includes blades, fins, or other aerodynamic surfaces that draw fluid into the impeller 112 and in a substantially axial direction (e.g., along 138), accelerate the fluid through rotation of the impeller 112, and discharge in at least partially radial directions that extend 360 degrees around the impeller 112. The discharged fluid is directed against a diffuser 140 coupled to or incorporated in the volute 114 to increase the pressure of the fluid, which is collected into one or more discharge passages 142 in the volute 114. In implementations, the volute 114 is concentrically aligned with the gearbox 104, such that each has a center axis of 136. The impeller 112 is eccentrically arranged relative to the volute 114 due to the alignment of the pinion 106 and the eccentric cartridge 110. The eccentricity of the impeller 112 and the volute 114 is shown in FIG. 4A, where the offset between the axis of rotation of the impeller 112 (e.g., center axis 138) and the center of the volute (e.g., center axis 136) corresponds to the offset 200 provided by the eccentric cartridge.

Figure 3:
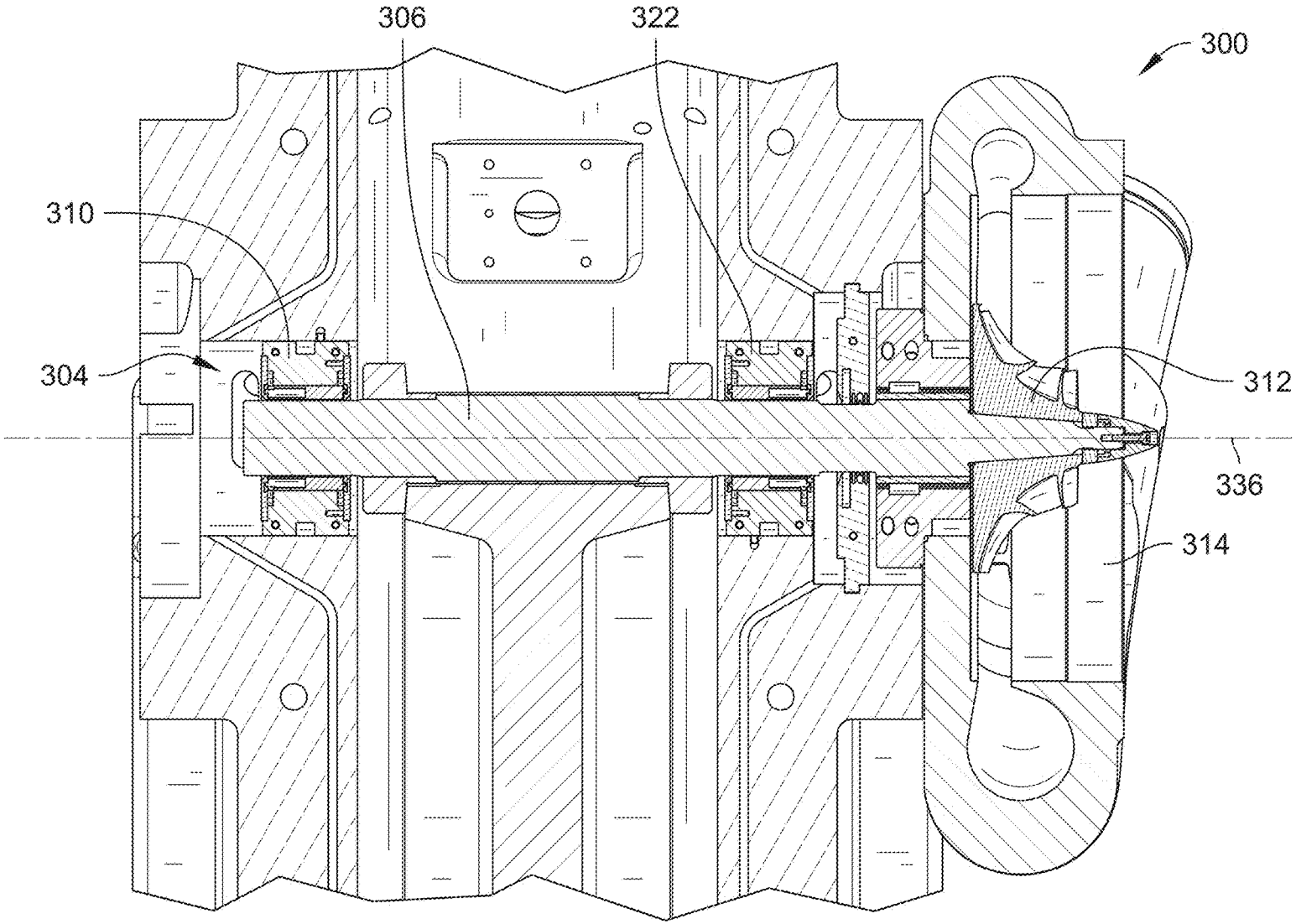
FIG. 3 is a partial cross-sectional view of an integrally geared centrifugal compressor system including a gearbox with no eccentricity between an axis of rotation of the rotor and the gearbox.
Figure 4B:
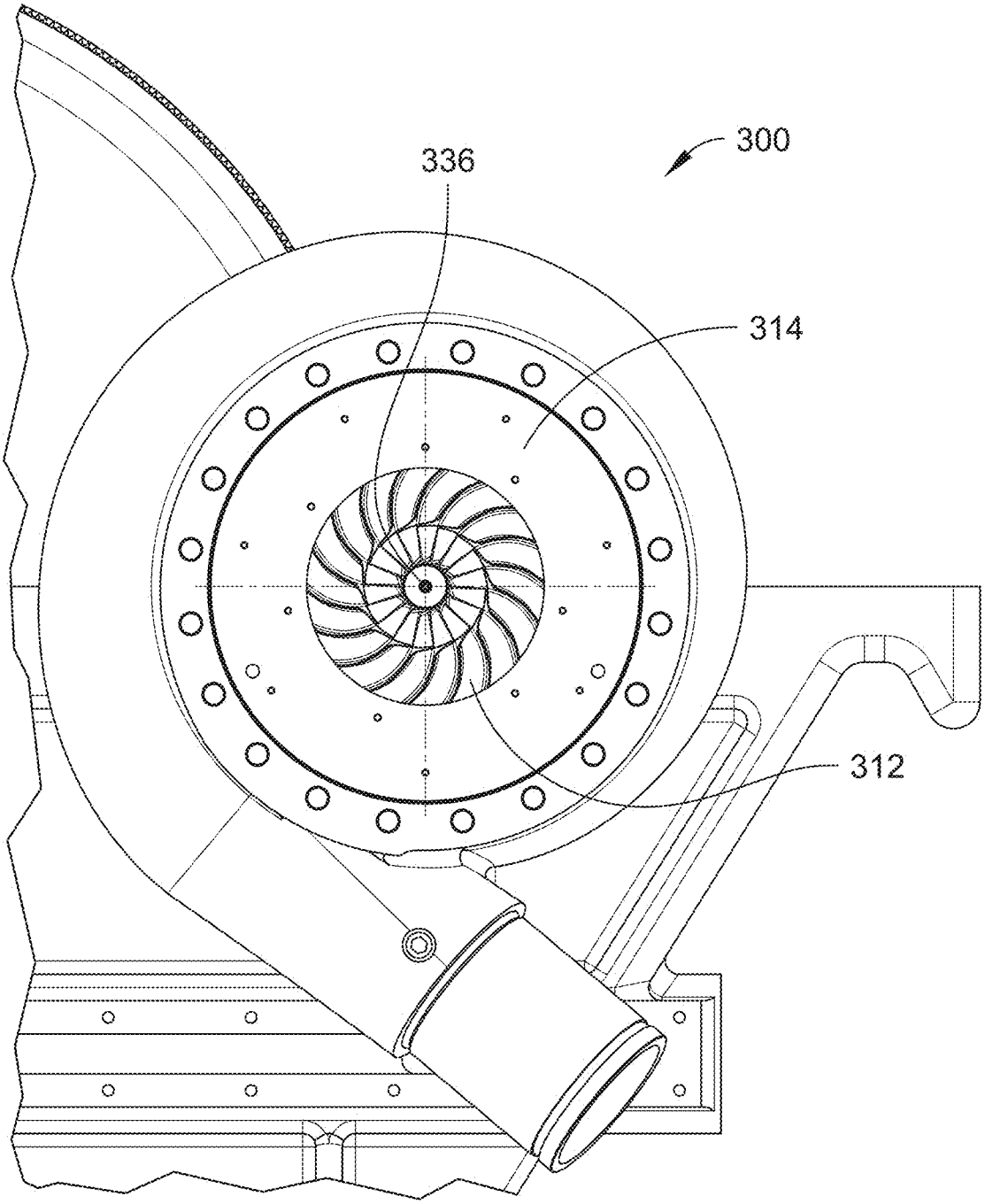
FIG. 4B is a partial end view of the system of FIG. 3, showing concentricity of the impeller relative to the volute.

Referring to FIG. 3, an integrally geared centrifugal compressor system ("system 300") is shown, where the system 300 does not include any eccentric cartridges 110. For instance, the system 300 is shown where the axis of rotation of a pinion 306 is aligned with the center of a gearbox 304 housing the pinion 306 and corresponding rotor 308 supported by bearings 322, shown as axis 336. The system 300 therefore is structured such that the pinion 306 is concentric with the gearbox 304, with no offset present. Additionally, an impeller 312 driven by the rotor 308 is concentric with a volute 314 configured to receive fluid from the impeller 312, as shown in FIG. 4B. If a different pinion gear tooth count was desired to change the operation of the system 300 (e.g., to increase or decrease rotational speeds of the impeller 312), the pinion 306 would have a larger or smaller diameter perpendicular to the axis of rotation to account for an increase or decrease in tooth count and would no longer be concentric with the bearings 322. The gearbox 304 and associated compressor package would then be redesigned to accommodate changes in the sizing of the pinion 306 to align the axis of rotation of the pinion 306 with the bearings 322 for proper rotational support and to align the impeller 112 with the volute 314. Therefore, in order for the system 300 to change operating conditions of the impeller 312 and the output to the volute 314, the gearbox 304 of the system 300 would require redesign to facilitate introduction of differing sized pinions 306. In contrast, the system 100 can be utilized to provide a range of speeds of the impeller 112 via changing the pinions 106 and the offset 200 of the eccentric cartridges 110 without requiring a redesign of the gearbox 104 or package components.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. An integrally geared centrifugal compressor system for compressing a fluid, the system comprising:

a pinion configured to be rotated by a bull gear about a rotational axis;

a rotor coupled to the pinion and configured to be rotated about the rotational axis;

an eccentric cartridge configured to house a bearing assembly through which the rotor extends to support rotation of the rotor about the rotational axis, the eccentric cartridge configured to seat against an interior surface of a gearbox having a center axis configured to house at least a portion of the pinion and the rotor, the eccentric cartridge configured to eccentrically arrange the rotational axis relative to the center axis of the gearbox;

an impeller coupled to the rotor and configured to draw fluid into the impeller upon rotation of the impeller, the impeller configured to be rotated about the rotational axis to eject the fluid; and a volute, wherein at least a portion of the impeller is positioned within the volute to direct the ejected fluid from the impeller into the volute, wherein the impeller is eccentrically arranged relative to the volute.

2. The system of claim 1, further comprising an oil seal, wherein the eccentric cartridge is configured to house the oil seal.

3. The system of claim 1, further comprising an air seal, wherein the eccentric cartridge is configured to house the air seal.

4. An integrally geared centrifugal compressor system for compressing a fluid, the system comprising:

a gearbox defining an interior longitudinal cavity having a center axis;

a pinion configured to be rotated by a bull gear about a rotational axis;

a rotor coupled to the pinion and configured to be rotated about the rotational axis;

an eccentric cartridge configured to house a bearing assembly through which the rotor extends to support rotation of the rotor, the eccentric cartridge configured to seat against an interior surface of the gearbox, the eccentric cartridge configured to eccentrically arrange the rotational axis relative to the center axis of the gearbox;

an impeller coupled to the rotor and configured to draw fluid into the impeller upon rotation of the impeller, the impeller configured to be rotated about the rotational axis to eject the fluid; and a volute, wherein at least a portion of the impeller is positioned within the volute to direct the ejected fluid from the impeller into the volute, wherein the impeller is eccentrically arranged relative to the volute.

5. The system of claim 4, further comprising an oil seal, wherein the eccentric cartridge is configured to house the oil seal.

6. The system of claim 4, further comprising an air seal, wherein the eccentric cartridge is configured to house the air seal.

* * * * *